US005766049A

United States Patent [19]

Letourneau

[11] Patent Number: 5,766,049

[45] Date of Patent: Jun. 16, 1998

[54] ANCHOR MONITOR AND RETRIEVAL BUOY

[76] Inventor: Dana Letourneau, 622 Glenoaks Blvd., San Fernando, Calif. 91340

[21] Appl. No.: 686,568

[22] Filed: Jul. 26, 1996

[51] Int. Cl.[6] ..... B63B 22/00

[52] U.S. Cl. ..... 441/16; 441/26; 114/293; 114/297

[58] Field of Search ..... 114/293, 294, 114/297; 441/1, 11, 23, 24, 25, 26, 27, 28, 16

[56] References Cited

U.S. PATENT DOCUMENTS

| | | | |
|---|---|---|---|
| 1,993,974 | 3/1935 | McVicker | 441/26 |
| 4,501,563 | 2/1985 | Johnson et al. | 441/26 |
| 4,808,133 | 2/1989 | Gram et al. | 441/26 |
| 5,445,103 | 8/1995 | Bleth et al. | 114/293 |

*Primary Examiner*—Stephen Avila
*Attorney, Agent, or Firm*—Wendy K. Buskop; Chamberlain, Hrdlicka et al.

[57] ABSTRACT

This nautical buoy is used to monitor the surface projection of a deployed anchor by floating above the anchor. This is accomplished by a connecting tether-line (16) from the buoy to the trip-eye of an anchor (48) attached using a shackle (18). As the anchor is lowered using the vessel's normal ground tackle, the tether-line (16) is deployed by unreeling from the buoy until the anchor rests on the bottom. The tether-line (16) is then secured from further deployment using a tether-line restraining tab (19) and the buoy is tossed overboard so as to float above the deployed anchor. A steady or flashing, light can be affixed to the top of the buoy to identify its location in subdued-light conditions. The buoy can also assist in retrieving an anchor, while aboard the vessel, that has been fouled on bottom vegetation, rocks, and/or other debris. Retrieving the anchor is accomplished by pulling on the tether-line (16), thus applying tensional forces nearly opposite to the frictional forces fouling the anchor. The buoy consists of a rotating plate (22) upon which is fixed a flotation chamber (12) to provide positive buoyancy. A stationary base plate (14) is attached to the rotating plate (22) by two spindles (28 and 30) so that the rotating plate (22) can revolve about the stationary base plate (14). This assembly allows one end of a tether-line (16) to be attached to the buoy, reeled within the buoy for storage, and unreeled upon deployment.

16 Claims, 8 Drawing Sheets

ANCHOR MONITOR AND RETRIEVAL BUOY

BACKGROUND OF THE INVENTION

The present invention relates to a nautical buoy for attachment to an anchor. BUOY will herein refer to my invention.

The term "Ground Tackle" refers to the anchor, anchor chain, and nylon anchor line of a vessel. It is a common occurrence, in anchorages frequented by numerous recreational and fishing vessels, for mariners to inadvertently cross their ground tackle with the ground tackle deployed by other vessels. The crossing of ground tackle is principally caused by not knowing where the other mariner's anchor is set on the bottom nor the relationship between his set anchor and his vessel.

When crossed ground tackle is retrieved, or pulled aboard the vessel, it often becomes tangled with the ground tackle of the other vessel. Continued retrieval efforts become difficult and the ensuing tangle of ground tackle can result in the dislodging of the other vessel's anchor. This can have serious consequences especially if that vessel is unoccupied and/or if it is close to rocks, a cliff-face, or the shore. A buoy to assist mariners in avoiding crossing ground tackle would be very desirable.

Anchors sometimes also become fouled on the bottom and can be very difficult to dislodge. The inability to retrieve a fouled anchor may require the mariner diving to the bottom in an attempt to free the anchor of the foul. This may not be possible if the anchor is fouled in deep water, if no diving gear is aboard, or if the mariner is alone and unable to attend the vessel once the anchor is free and he is still in the water. Severing the ground tackle from the vessel can often be the only option. A device to assist in the freeing and retrieval of a fouled anchor would be very desirable.

Anchor buoys and illuminated buoy markers have been designed to service various functions. Marine buoys or floatable markers are not only used to define safe channels of passage through waterways but are also utilized to mark specific locations such as to identify fishing spots, traps for marine life, or to mark subsurface locations so that such locations may be readily relocated in the future. Illuminating a marine buoy or floatable marker enables the mariner to identify the device in subdued-light or night-time conditions. An illuminated anchor buoy would be very desirable.

In U.S. Pat. No. 3,654,649 to Richardson, a device was designed to retrieve an anchor chain severed from an already-deployed and fouled anchor. A problem with this device is that it may not be possible, or practical, to revisit the location of the fouled anchor in an attempt to free it and this device cannot assist in breaking the anchor free of the foul.

OBJECTS OF THE INVENTION

My BUOY is designed so as to alert other mariners as to the position of a deployed anchor and/or to be able to retrieve it, while the mariner is still aboard, should the anchor be fouled by bottom features.

The objects of my invention are to identify the surface projection of deployed nautical anchors, in day and night conditions, alert other mariners as to the location of deployed anchors, and to assist in retrieving anchors fouled by such bottom features as seaweed, rocks, and debris. My invention also provides a means for retrieving an anchor which has become cut off from the vessel such as from storm induced chafing of the rode.

SUMMARY OF THE INVENTION

Prior to deploying a vessel's ground tackle, including the anchor, the BUOY is temporarily attached to the vessel, near the anchor, so as to allow free and unrestricted deployment of a tether-line coiled within the BUOY. The tether-line is attached from the BUOY to the trip-eye of the anchor. The trip-eye is located on the opposite end of the anchor's shank where the vessel's ground tackle is attached. As the anchor is lowered overboard into the water, using the vessel's ground tackle, the tether-line of the BUOY is dispensed from the BUOY. Once the anchor rests on the bottom the tether-line is secured from further deployment from the BUOY and the BUOY is tossed overboard so as to float above the anchor.

The preferred embodiment of my BUOY is a flotation chamber incorporating a reel from which the tether-line can be reeled and unreeled. The BUOY can include a signal device or devices which may include a solar-recharged and photovoltaically-activated, light-emitting diode, or other light source, fixed on the BUOY so as to be above the water surface when the BUOY is deployed in the water. The BUOY's housing may also be made light-reflective such as by having light-reflective tape or other means for reflecting light affixed to the housing. When the BUOY is deployed in the evening hours, the BUOY can emit a flashing or constant light to alert mariners of its location. The BUOY can also be located at night by shining a flashlight in its direction and detecting the reflected light thereby determining the location of a deployed anchor.

My BUOY can also assist in retrieving a fouled anchor. When trying to retrieve a fouled anchor, the vessel is commonly floating directly above the fouled anchor due to the mariner's previous efforts to pull the ground tackle aboard. At this point, the BUOY can be brought aboard using a long pole and hook. The tether-line, attached to the anchor's trip-eye, is heartily pulled by the mariner so as to free the anchor of the foul. The anchor can be freed because the mariner's pulling on the tether-line applies forces opposite to the fouling frictional forces. Once free, the anchor can then be retrieved using the vessel's normal ground tackle or be pulled aboard using the tether-line attached to the anchor. After the anchor is aboard, the BUOY is simply pulled onto the vessel by the attached tether-line and then the tether-line is reeled within the BUOY.

BRIEF DESCRIPTION OF THE DRAWINGS

FIG. 4A is a detail of a portion of the device shown in FIG. 4.

FIG. 8A shows that pulling on the tether line will free the anchor from the foul. FIG. 8B shows that continued pulling on the tether line will free the anchor and lift the anchor off the bottom. FIG. 8C shows that further pulling on the tether line can retrieve the anchor aboard.

DETAILED DESCRIPTION OF THE PREFERRED EMBODIMENTS

Figure 1:
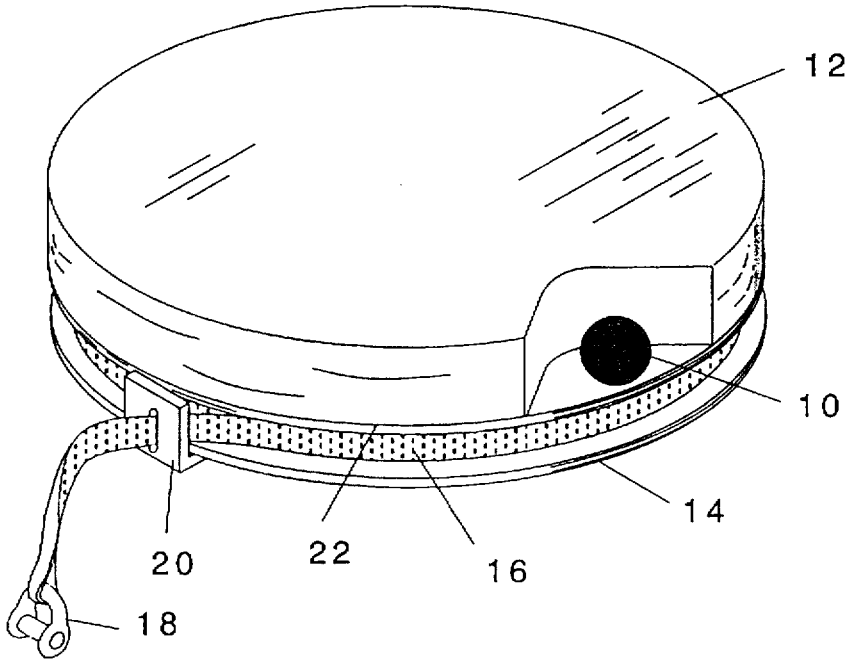
FIG. 1 is a top perspective of the BUOY.
Figure 2:
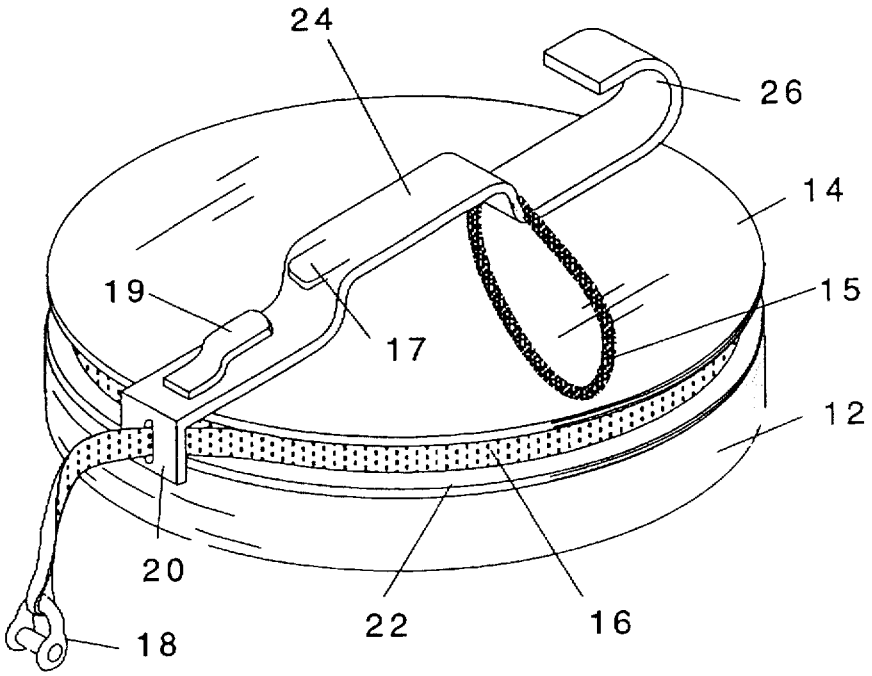
FIG. 2 is a bottom perspective of the BUOY.
Figure 3:
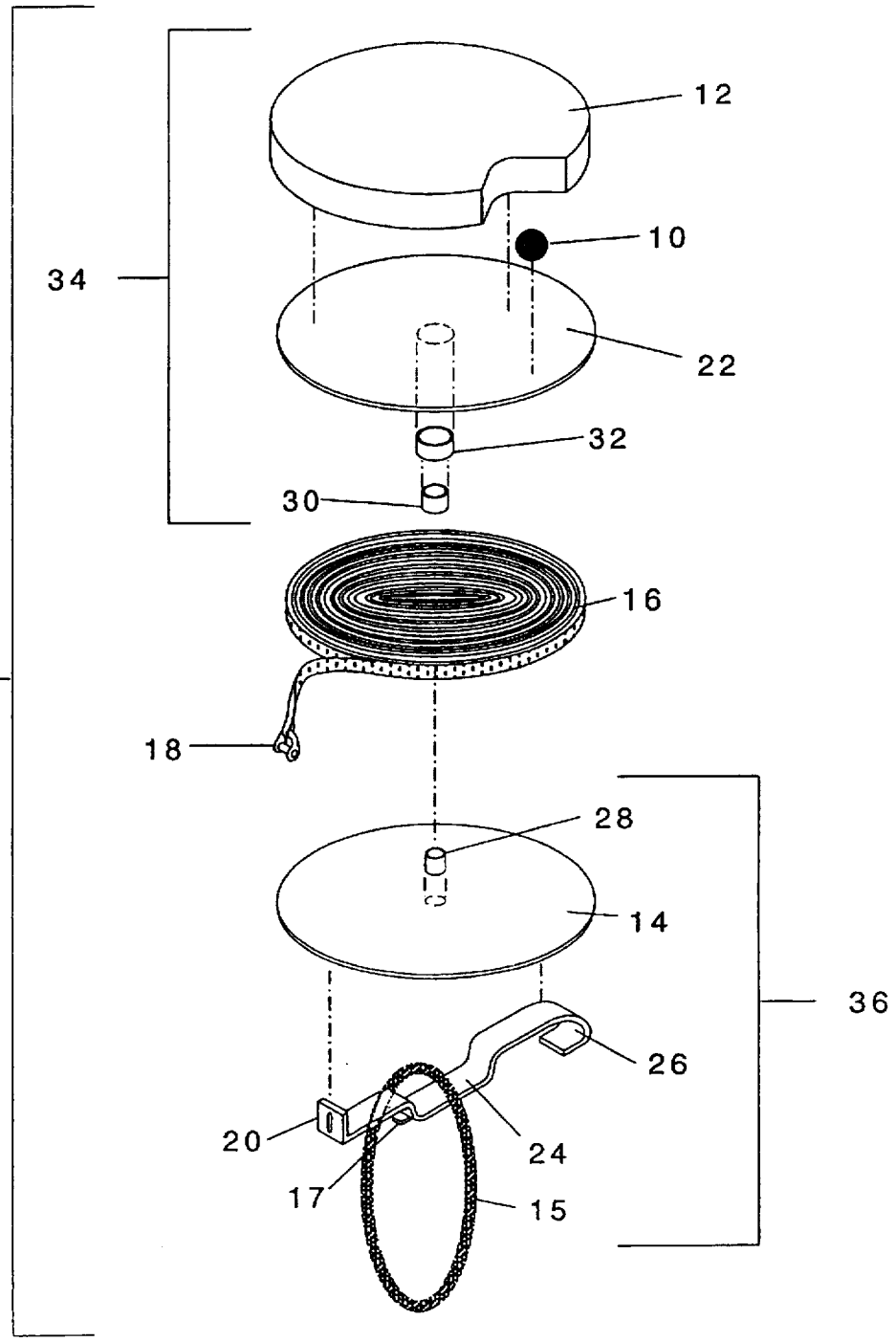
FIG. 3 is an exploded view of the BUOY's components.

A preferred embodiment of my BUOY is illustrated in FIG. 1 (top perspective), in FIG. 2 (bottom perspective), and in FIG. 3 (exploded view).

Generally speaking, the BUOY comprises a float, a nose piece, a means for connecting the nose piece to the float, an end plate and a spindle.

Preferably, the float is generally cylindrical and has a first end surface, a second end surface, a longitudinal axis, and a length to diameter ratio of less than about 1. The length to diameter ratio permits the float to float upright in the water. The float can be formed by a flotation chamber 12, or from other materials, such as plastic foam.

The generally tubular nose-piece can be formed by an outer spindle 30. The nose-piece is connected to the second end surface of the float so that the generally tubular nose piece extends generally axially from the second end surface of the float. Preferably the nose piece is connected to the float by a plate having a disk shape which has an inside end surface, an outside end surface, and a diameter near the diameter of the float. A suitable plate is can be formed by rotating plate 22. The plate is attached to the inside end surface of the float. The outside end surface of the plate is positioned adjacent to the inside end surface of the float and the inside end surface of the plate has the generally tubular nose piece extending generally axially therefrom.

The end plate is preferably generally disk-shaped and has a first end surface, a second end surface and a longitudinal axis positioned in coaxial relationship with the longitudinal axis of the float. Base plate 14 is illustrative of a suitable end plate.

The spindle generally extends axially from the first end surface of the end plate. The spindle is secured to the generally tubular nose piece connected to the float for rotational motion between the float and the end plate. The second end surface of the float is spaced apart from the first end surface of the end plate to define a reel. Inner spindle 28 is illustrative.

In a preferred embodiment, the second end surface of the float is spaced apart from the first end surface of the end plate by the plate having the disk shape. The reel is defined between the second end surface of the plate having the disk shape and the first end surface of the generally disk-shaped end plate. A tether line 16 is coiled on the reel.

In the illustrated embodiment of the invention, the flotation chamber 12, is attached and secured to rotating base 22. A tether-line locking spindle 32 is attached to the center of rotating plate 22. An outer spindle 30 is also attached to the center of rotating plate 22 and centered within tether-line locking spindle 32 allowing enough space to secure one end of a tether-line 16 to tether-line locking spindle 32.

An inner spindle 28 which is designed to fit into outer spindle 30 is attached to the base plate 14. In the preferred embodiment of my BUOY, an assembled rotating plate 34 and an assembled base plate 36 are joined so that inner spindle 28 can fit snugly into outer spindle 30 and rotating plate 34 can rotate freely about base plate 14. Assembled rotating plate 34 and assembled base plate 36 are secured to one another so as to not allow their accidental separation and to allow for the free rotation of assembled rotating plate 34.

In a preferred embodiment of the invention, the float has a generally cylindrical outer periphery with a notch defined in the generally cylindrical outer periphery. A knob is mounted to the first end surface of the of the plate having the disk shape for rotation about an axis parallel to the longitudinal axis of the float. The knob is positioned in the notch. Preferably, a rotating-knob 10 is attached on the outer edge of rotating plate 22 so that rotating-knob 10 can turn with ease. In the preferred embodiment of my BUOY, the flotation chamber 12 is designed so as to have a significant positive buoyancy and allow free access to rotating-knob 10.

Preferably, a handle is attached to the second end surface of the generally disk-shaped end plate and extends generally diametrically thereacross. Handle 24 attached to base plate 14 is illustrative. Generally speaking, the handle has a first end and a second end. Preferably the first end has a generally J shaped bend extending away from the generally disk-shaped end plate. Attaching hook 26 is illustrative. The second end of the handle preferably has a generally L shaped bend having an end leg extending across the reel. The end leg defines a slot and the tether line extends through the slot. The slot forms a tether-line guide 20 which facilitates the reeling-in of tether-line 16 and minimizes tangling of tether-line 16.

Tether-line 16 is passed through tether-line guide 20 of handle 24 and secured to tether-locking spindle 32. Tether-line 16 is then wound around tether-locking spindle 32 by rotating assembled rotating base 34, using rotating-knob 10, while keeping assembled base plate 14 stationary. On the opposite end of a tether-line is a shackle 18 used to attach to a trip-eye of an anchor as well as to prevent the end of tether-line 16 from passing through tether-line guide 20 when reeling in tether-line 16.

In a further preferred embodiment, the handle further has a central portion spaced apart from the second end of the generally disk-shaped end plate to form a grip. A means for securing the tether line is positioned between the L shaped bend and the grip. The means for securing the tether line may be formed a cleat or from a tab portion of the handle, for example. Tether-line restraining tab 19 to secure tether-line 16 from further deployment is illustrative.

In a further preferred embodiment of the invention, an elastomeric band is positioned around the central portion of the handle and a second cleat is positioned on the central portion of the handle for securing the elastomeric band. In the illustrated embodiment, an elastic restraining strap 15 is situated between a handle 24 and a base plate 14. Handle 24 may also incorporate a restraining strap tab 17 to secure elastic restraining strap upon attachment to the vessel.

Deployment of the BUOY

Figure 4:
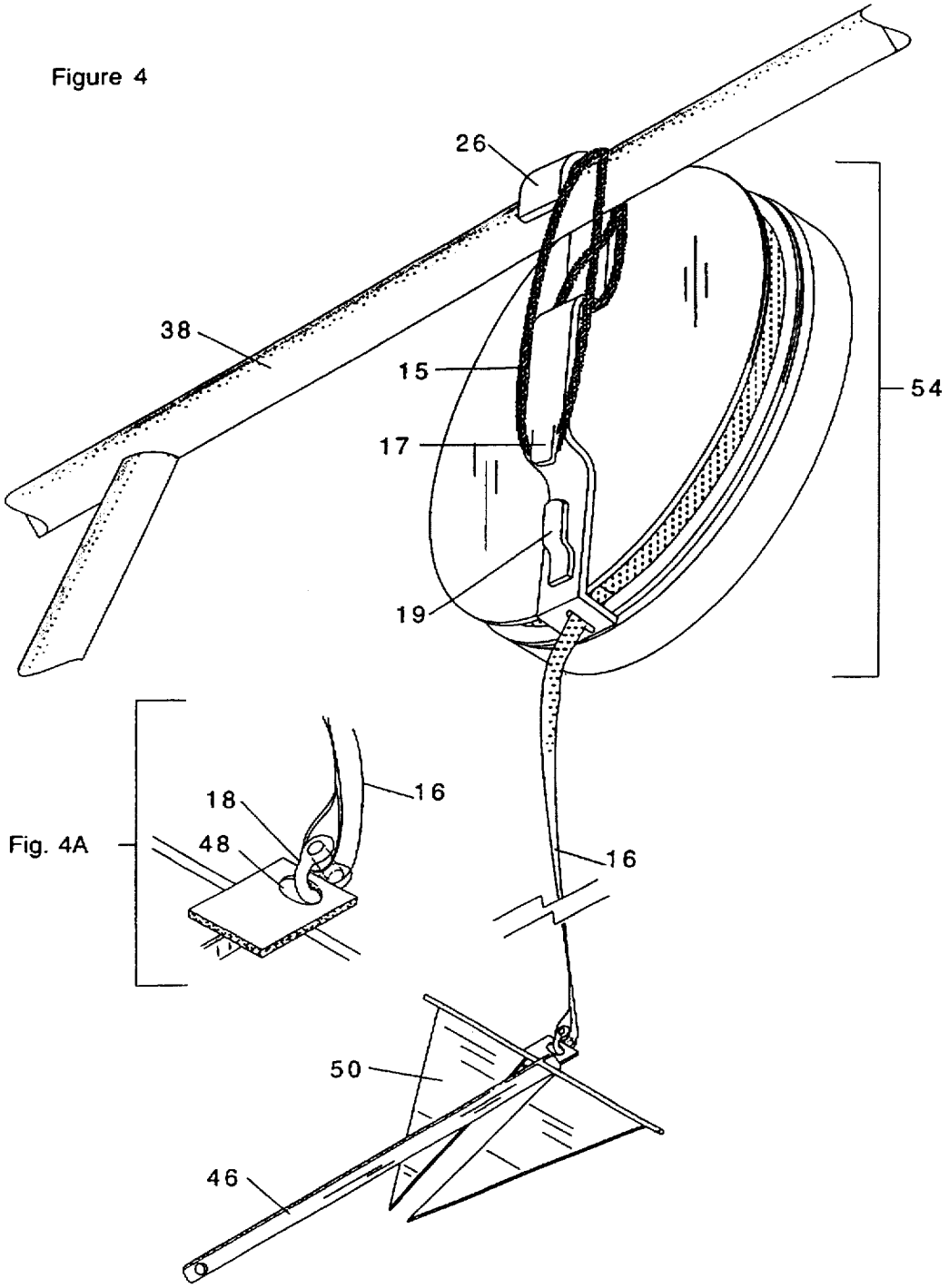
FIG. 4 is a diagrammatic upward-looking perspective of the BUOY temporarily attached to either the bow or stern rail of a vessel and showing the shackle securing the tether-line to the trip eye of an anchor.
Figure 5:
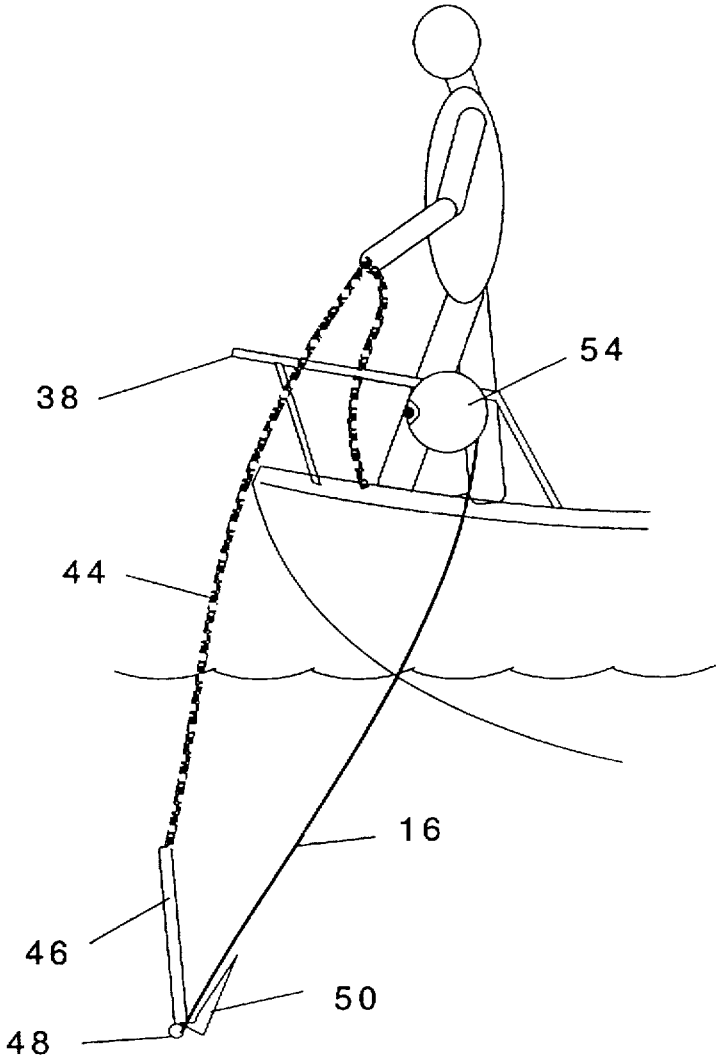
FIG. 5 is a view of an anchor being lowered causing the deployment of the tether-line from the BUOY.
Figure 6:
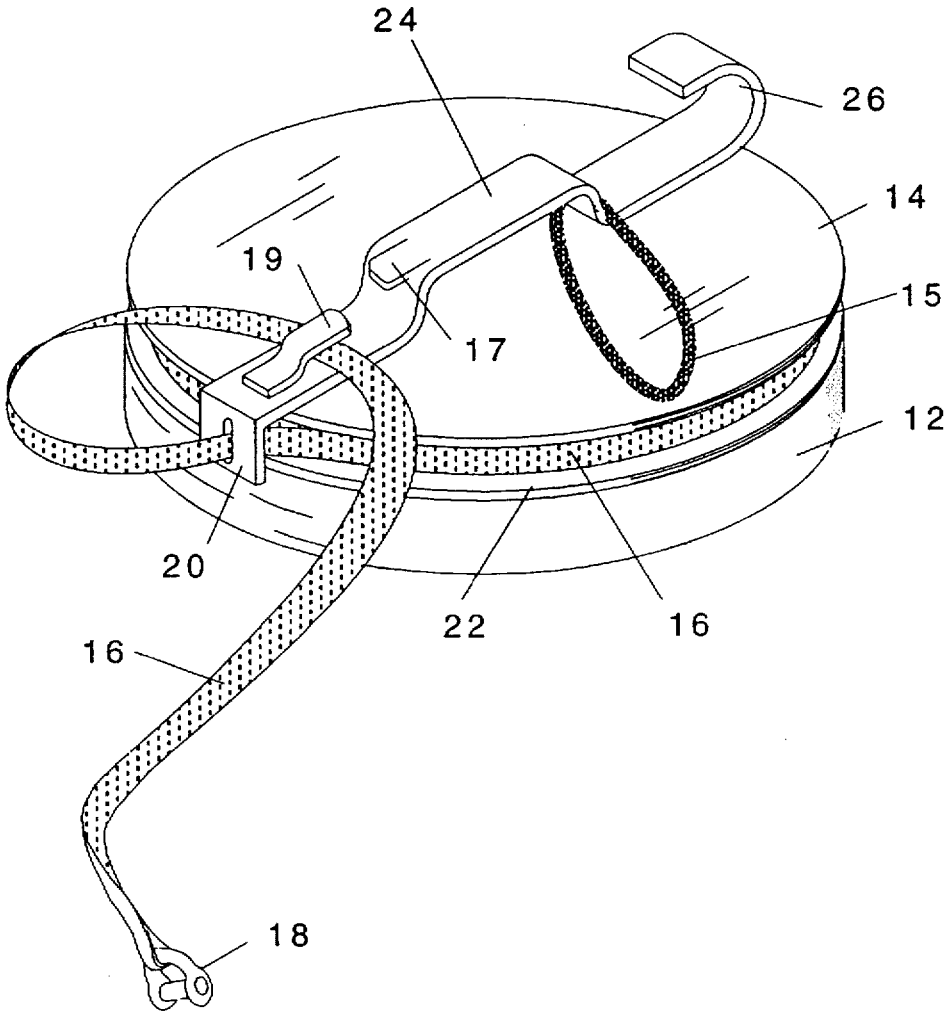
FIG. 6 is diagrammatic perspective of the BUOY with the tether-line secured from further deployment by a tether-line restraining tab.

FIGS. 4, 5, and 6 illustrate the preferred deployment sequence. Initially, a BUOY 54 is temporarily attached, using attaching hook 26 and restraining strap 17, to a convenient portion of a vessel and near the anchor to be deployed. FIG. 4 illustrates how BUOY 54 is temporarily attached to either a bow or stem rail 38 on a vessel. Elastic restraining strap 15 can be wrapped around bow or stem rail 38 and secured using restraining strap tab 17 causing BUOY 54 to be secured to the rail. Shackle 18 is then securely attached to a trip-eye 48 of an anchor. The trip-eye is located between the anchor flukes 50, and on the opposite end of the anchor shank 46 to where the ground tackle is attached.

The anchor, with attached tether-line 16 and shackle 18, is then lowered overboard using anchor chain 44 in a hand-overhand fashion, by a winch, or by a windlass as noted in FIG. 5. While the anchor is being lowered into the water, tether-line 16 is being pulled and unreeled from BUOY 54 causing the rotation of assembled rotating plate 34 about assembled base plate 36.

Figure 7:
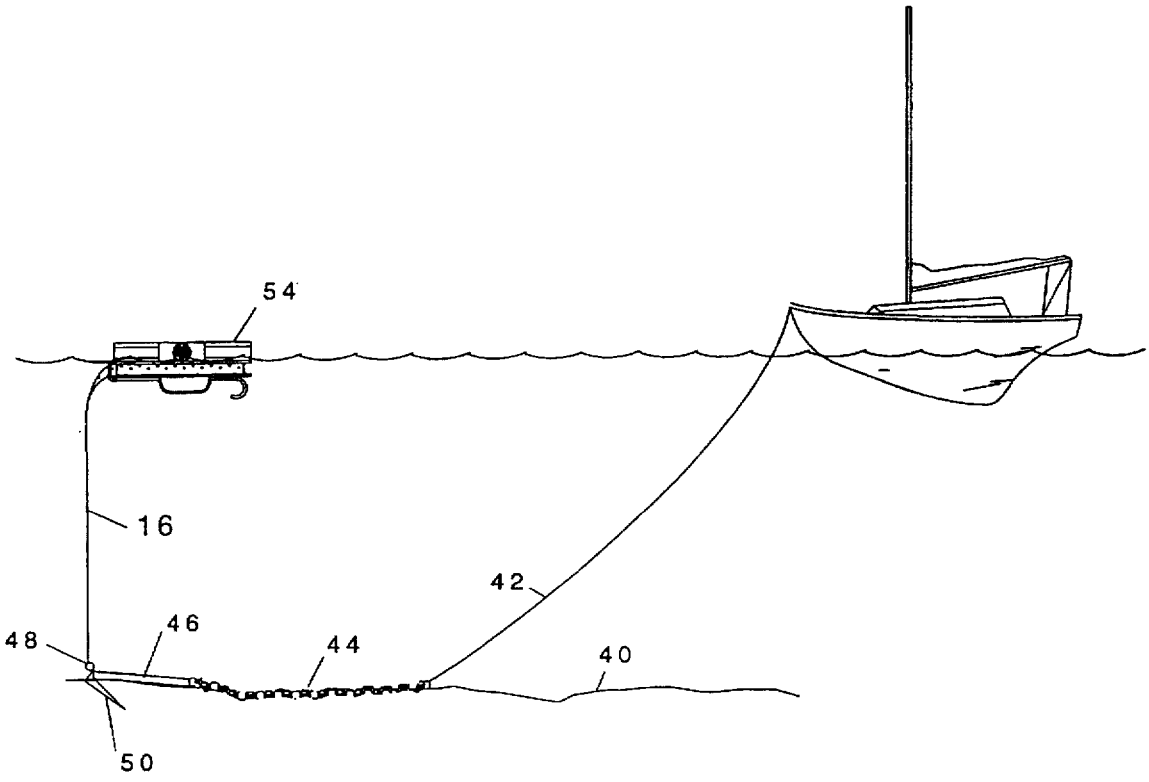
FIG. 7 is a perspective of the BUOY floating above the deployed anchor.

Once the anchor rests on the bottom, BUOY 54 is held in the mariner's hand and tether-line 16 is secured from further unreeling and deployment using tether-line restraining tab 19 as illustrated in FIG. 6. BUOY 54 is then tossed overboard so as to float above the deployed anchor as illustrated in FIG. 7. The mariner can now set the deployed anchor as normal.

Retrieving A Fouled Anchor

Figure 8C:
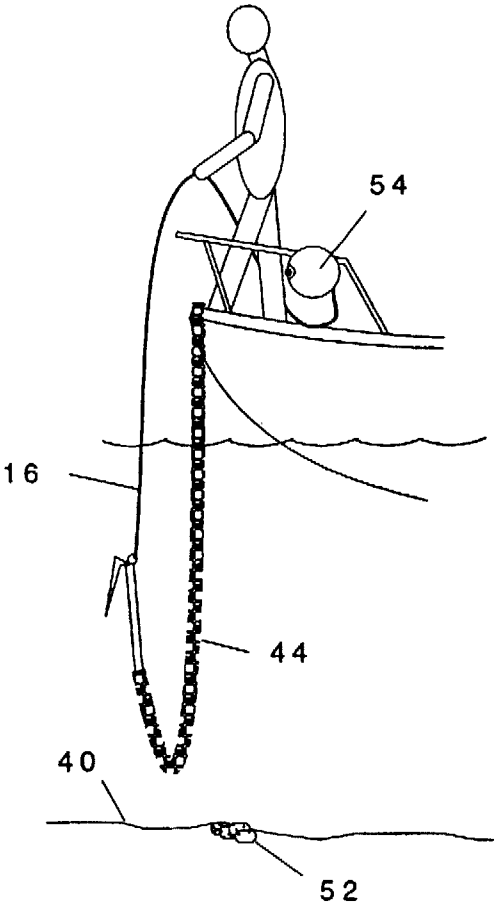
FIGS. 8A, 8B and 8C pictorially illustrate a sequence of motions using the BUOY tether-line to retrieve a fouled anchor.
Figure 8B:
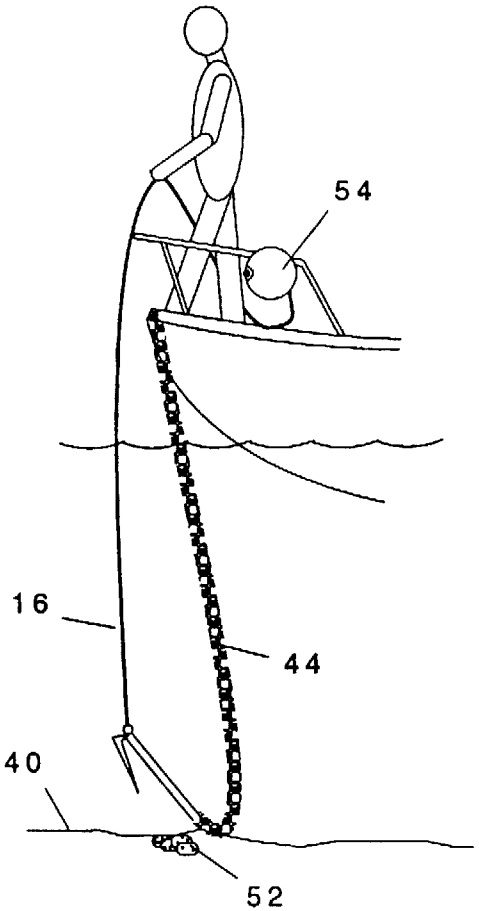
Figure 8A:
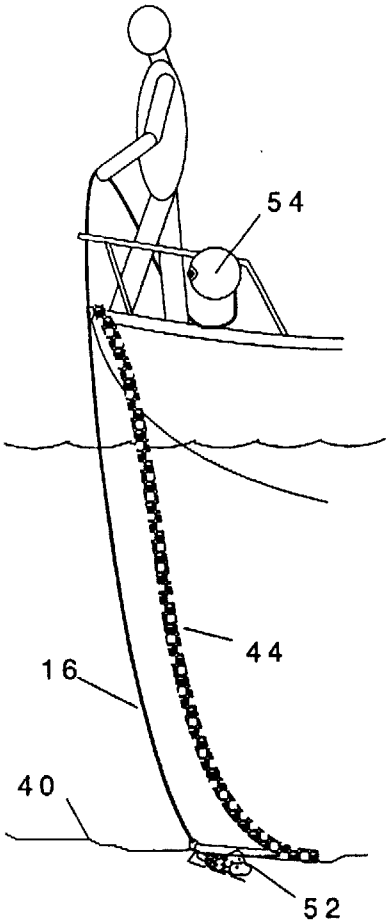

An anchor may be considered fouled when the mariner is unable to pull the anchor aboard by hand, winch, or windless. In such a situation, the vessel is often directly above the fouled anchor because the mariner has already tried to pulled aboard as much nylon anchor line 42 and anchor chain 44 as possible. FIG. 8 illustrates the sequence of motions when using BUOY 54 to free an anchor fouled on bottom fouling features such as rocks 52.

Since BUOY 54 is floating above the fouled anchor, a long boat-hook can be used to bring BUOY 54 aboard. The mariner then pulls, often with considerable force, on tether-line 16 to free the fouled anchor. This is possible because the force used to free the anchor is nearly opposite to the frictional forces holding the anchor in place. Continued pulling generally frees the anchor from the foul. With further pulling, the anchor is brought aboard. The remaining deployed anchor chain 44 can then be pulled aboard.

Thus the reader will see that my BUOY provides a valuable service to the mariner by identifying the location of deployed anchors, in day and nighttime conditions, and assisting in the retrieval of fouled or severed anchors. The design of the BUOY is simple, economical to manufacture, requires no routine maintenance, and is useable by most mariners.

The safety considerations of using the BUOY include minimizing the crossing of the mariner's ground tackle with that of another vessel's ground tackle thereby reducing the possibility of unsetting another mariner's anchor; and assisting the mariner to retrieve an anchor which has been fouled on vegetation, rocks, and/or other bottom debris.

While my above description contains many specificities, these should not be construed as limitations on the scope of the invention, but rather as an exemplification of one preferred embodiment thereof. Many other variations are possible.

For example, a chemiluminescent or a pulsing or steady identification light may be incorporated as a mechanism within or attached to the flotation chamber so as to be activated only at night and to allow recharge of the batteries during the day. The BUOY can also have incorporated in the flotation chamber a reflective housing, or reflective tape or other reflective device can be affixed to the flotation chamber, so the BUOY can be identified at night with only a flashlight.

Another variation is the addition of a telescoping rod affixed to the BUOY so as to attach a brightly-colored warning flag to alert other mariners as to the location of the BUOY and the associated deployed anchor. The telescoping rod can also allow the mariner to reach over the side of the vessel and retrieve the BUOY from the water while aboard the vessel without using a boat-pole and hook.

Accordingly, the scope of the invention should be determined not by the embodiment illustrated, but by the appended claims and their legal equivalents.

What is claimed is:

1. Apparatus comprising (a) a generally cylindrical float having a first end surface, a second end surface, a longitudinal axis, and a length to diameter ratio of less than about 1;

(b) a generally tubular nose-piece, (c) means for connecting the generally tubular nose-piece to the second end surface of the float so that the generally tubular nose piece extends generally axially from the second end surface of the float;

(d) a generally disk-shaped end plate having a first end surface, a second end surface and a longitudinal axis positioned in coaxial relationship with the longitudinal axis of the float; and (e) a spindle extending generally axially from the first end surface of the end plate, said spindle being secured to the generally tubular nose piece connected to the float for rotational motion between the float and the end plate, wherein the second end surface of the float is spaced apart from the first end surface of the end plate to define a reel.

2. Apparatus as in claim 1 wherein the means for connecting the generally tubular nose piece to the float comprises:

(a) a plate having a disk shape having an inside end surface, an outside end surface, and a diameter near the diameter of the float attached to the inside end surface of the float, wherein the outside end surface of the plate is positioned adjacent to the inside end surface of the float and the inside end surface of the plate has the generally tubular nose piece extending generally axially therefrom.

3. Apparatus as in claim 2 wherein the second end surface of the float is spaced apart from the first end surface of the end plate by the plate having the disk shape, wherein the reel is defined between the second end surface of the plate having the disk shape and the first end surface of the generally disk-shaped end plate, said apparatus further comprising:

(a) a tether-line coiled on said reel.

4. Apparatus as in claim 3 wherein the float has a generally cylindrical outer periphery with a notch defined in the generally cylindrical outer periphery, said apparatus further comprising a knob mounted to the first end surface of the of the plate having the disk shape for rotation about an axis parallel to the longitudinal axis of the float, said knob being positioned in the notch.

5. Apparatus as in claim 4 further comprising (a) a handle attached to the second end surface of the generally disk-shaped end plate and extending generally diametrically thereacross.

6. Apparatus as in claim 5 wherein the handle has a first end and a second end, wherein the first end has a generally J shaped bend extending away from the generally disk-shaped end plate and the second end has a generally L shaped bend having an end leg extending across the reel, wherein the end leg defines a slot and the tether line extends through the slot.

7. Apparatus as in claim 6 wherein the handle further has a central portion spaced apart from the second end of the generally disk-shaped end plate to form a grip and a cleat positioned between the L shaped bend and the grip for securing the tether line.

8. Apparatus as in claim 7 wherein the cleat is formed from a tab portion of the handle.

9. Apparatus as in claim 8 further comprising an elastomeric band positioned around the central portion of the handle, and a second cleat positioned on the central portion of the handle for securing the elastomeric band.

10. A method for deploying an anchor from a floating vessel, said method comprising:

attaching the anchor to ground tackle, said ground tackle having a first end attached to the anchor and a second end attached to the vessel;

attaching the anchor to a tether line, said tether line having a first end attached to the anchor and a second end attached to a buoyant reel on the vessel, said tether line being coiled on the reel, said buoyant reel having a generally cylindrical float having a first end surface, a second end surface, a longitudinal axis, and a length to diameter ratio of less than about 1, said buoyant reel further having a generally tubular nose-piece and means for connecting the generally tubular nose-piece to the second end surface of the buoyant reel so that the generally tubular nose piece extends generally axially from the second end of the float, said buoyant reel further having a generally disk-shaped end plate having a first end surface, a second end surface and a longitudinal axis positioned in coaxial relationship with the longitudinal axis of the buoyant reel, said buoyant reel further having a spindle extending generally axially from the first end surface of the end plate, said spindle being secured to the generally tubular nose piece connected to the buoyant reel for rotational motion between the float and the end plate, wherein the second end surface of the buoyant reel is spaced apart from the first end surface of the plate to define a reel;

lowering the anchor by playing out the ground tackle and unreeling the tether line until the anchor rests on the bottom;

securing the tether line to the buoyant reel to prevent further unreeling; and tossing the buoyant reel overboard to float above the anchor.

11. A method as in claim 10 wherein the ground tackle is attached to a first end of the anchor; and the tether line is attached to a second end of the anchor.

12. A method for freeing a fouled anchor of a floating vessel, wherein said anchor has a first end and a second end and the first end is attached to the floating vessel by ground tackle; said method comprising:

positioning a floating reel above the anchor, said floating reel being attached to the second end of the anchor by a tether line, said tether line being coiled on the floating reel, said floating reel having a generally cylindrical float having a first end surface, a second end surface, a longitudinal axis, and a length to diameter ratio of less than about 1, said floating reel further having a generally tubular nose-piece and means for connecting the generally tubular nose-piece to the second end surface of the floating reel so that the generally tubular nose piece extends generally axially from the second end of the float, said floating reel further having a generally disk-shaped end plate having a first end surface, a second end surface and a longitudinal axis positioned in coaxial relationship with the longitudinal axis of the floating reel, said floating reel further having a spindle extending generally axially from the first end surface of the end plate, said spindle being secured to the generally tubular nose piece connected to the floating reel for rotational motion between the float and the end plate, wherein the second end surface of the floating reel is spaced apart from the first end surface of the plate to define a reel;

retrieving the floating reel onto the vessel; and pulling on the tether line to free the fouled anchor.

13. A method as in claim 12 further comprising retrieving the freed anchor onto the vessel.

14. A portable nautical buoy device comprising:

(a) a buoyant housing having positive buoyancy, said buoyant housing having a generally cylindrical float having a first end surface, a second end surface, a longitudinal axis, and a length to diameter ratio of less than about 1, said buoyant housing further having a generally tubular nose-piece and means for connecting the generally tubular nose-piece to the second end surface of the buoyant housing so that the generally tubular nose piece extends generally axially from the second end of the float, said buoyant housing further having a generally disk-shaped end plate having a first end surface, a second end surface and a longitudinal axis positioned in coaxial relationship with the longitudinal axis of the buoyant housing, said buoyant housing further having a spindle extending generally axially from the first end surface of the end plate, said spindle being secured to the generally tubular nose piece connected to the buoyant housing for rotational motion between the float and the end plate, wherein the second end surface of the buoyant housing is spaced apart from the first end surface of the plate to define a reel;

(b) a means to temporarily attach the device to a portion of a nautical vessel;

(c) a line attached to the center of and wound around said reel;

(d) an opening in said housing adjacent to said reel through which said line passes to untangle said line on said reel;

(e) a means of attaching said line to a conventional anchor;

(f) a battery-powered or chemiluminescent light-emitting source supported by said housing; and (g) a housing with the means of reflecting light from another light source.

15. A portable nautical buoy device of claim 14, further including:

(a) a means by which a mariner can monitor the location or surface projection of an anchor they have deployed from their vessel in both day and night conditions;

(b) a means by which other mariners on other vessels can identify the location or surface projection of an anchor deployed from another vessel in both day and night conditions;

(c) a means by which a mariner can monitor changes in his vessel's position relative to the position of his or her deployed anchor, (d) a means by which a mariner can retrieve his or her anchor which has been fouled by bottom features such vegetation, rocks, or debris; and (d) a means by which a mariner can retrieve his or her anchor which has been fouled by the ground tackle of another vessel.

16. A portable nautical buoy device of claim 14, further including:

(a) a means by which a mariner can retrieve an anchor accidently severed from the vessel.

* * * * *